US006022283A

United States Patent [19]

Schindler et al.

[11] Patent Number: 6,022,283

[45] Date of Patent: Feb. 8, 2000

[54] INFLATABLE BALL

[76] Inventors: Edgar C. Schindler, 11723 136th Avenue East, Puyallup, Wash. 98374; Dominnik Liang, 4636 177th Avenue SE., Issaquah, Wash. 98027

[ * ] Notice: This patent is subject to a terminal disclaimer.

[21] Appl. No.: 08/861,720

[22] Filed: May 22, 1997

Related U.S. Application Data

[63] Continuation of application No. 08/440,465, May 12, 1995, Pat. No. 5,636,835.

[51] Int. Cl.[7] ..... A63B 41/08

[52] U.S. Cl. ..... 473/605

[58] Field of Search ..... 473/605, 604

[56] References Cited

U.S. PATENT DOCUMENTS

| | | | |
|---|---|---|---|
| 3,119,618 | 1/1964 | Molltor et al. | 473/605 |
| 3,506,265 | 4/1970 | Yugi | 473/605 |
| 5,636,835 | 6/1997 | Schindler et al. | 473/605 |

*Primary Examiner*—Mark S. Graham
*Attorney, Agent, or Firm*—Bruce A. Kaser

[57] ABSTRACT

The invention disclosed and claimed here is a padded inflatable game ball. The ball is a seamed ball consisting of a spherical rubber bladder, a layer of winding surrounding the bladder, a cellular sponge layer surrounding the winding, and seams and external skin panel sections surrounding the cellular sponge layer. The sponge layer provides padding under the skin panel sections. The seams are made of narrow strips of high density rubber which cover a relatively small section of the overall surface area of the sponge layer. This allows outgassing of the sponge layer as it is foamed during the ball manufacturing process.

3 Claims, 4 Drawing Sheets

INFLATABLE BALL

This application is a continuation U.S. Pat. No. 5,636,835 of application Ser. No. 08/440,465, filed May 12, 1995.

TECHNICAL FIELD

This invention relates to inflatable game balls. More particularly, it relates to an inflatable ball having a layer of padding under its outer skin covering.

BACKGROUND INFORMATION

Over the years, basketballs have been standardized into an eight-panel outer surface design having raised seams exposed between the edges of exterior skin panels. High quality basketballs generally consist of an inner rubber bladder surrounded by a layer of winding. The winding is covered by an additional thin layer of high density black rubber. The arrangement of bladder, winding, and surrounding rubber layer are placed in a mold and cured to create the "carcass" of the ball.

The color of the rubber layer surrounding the winding and, consequently, the outer surface of the carcass is black. During the carcass molding process, raised ridges or black seams are molded from the rubber layer. Individual panel sections of leather are bonded to the rubber layer in the areas between the raised seams. After attachment of the panels the ball is completed in a finishing mold.

Basketballs have been made in the above manner for many, many years. The winding layer limits expansion of the bladder and assists it in retaining a spherical shape after inflation to a recommended pressure. It also prevents the air pressure within the bladder from being fully transferred to the outer covering defined by the panel sections and seams.

The outer covering provides durability and protection. It is common to use synthetic materials to make the panel sections. However, the highest quality balls use top-grain leather.

Over the years, ball manufacturers have designed balls having different versions of multi-layered carcasses and outer coverings. For one reason or another, these designs have not reached or survived in the marketplace.

One ball design developed in the past by the A.G. Spalding Co. ("Spalding design") includes a layer of cellular sponge material positioned between what is characterized as an "inner carcass" and outer skin. This design is illustrated in U.S. Pat. No. 3,119,618 ("'618 patent").

The Spalding design lacks the black rubber layer described above for creating raised seams. Although not described in the '618 patent, the sponge layer was probably created by techniques similar to the ones used today: a thin layer of foamable rubber is expanded into a cellular sponge layer after application of a chemical foaming agent and heat. This process creates a significant amount of outgassing during the foaming process.

Outgassing may have prevented Spalding from producing a seamed ball having a sponge layer underlying the outer covering. Or if it was attempted to make a seamed ball using the Spalding design, it is possible that raised seams were made from the material making up the sponge layer in the same way the seams are currently made from the high density black rubber layer of winding, as described above. If so, sponge layer seams would be ragged and not wear well. In any event, the Spalding design appears to lack raised, high density rubber seams in combination with a sponge layer. The net effect is that the Spalding design does not appear to duplicate the "look" of a high quality basketball.

The invention disclosed and claimed here is similar to but constitutes an improvement over the Spalding design. That is to say, the present invention is a "padded" game ball whose outer appearance is the same as present day high quality basketballs. The padded feature produces a ball having superior characteristics over and above conventionally made high quality balls.

SUMMARY OF THE INVENTION

The invention is an inflatable, raised seam game ball having a layer of padding underneath the outer covering. The carcass of the ball is preferably made in the following manner: a spherical rubber bladder is surrounded by a layer of winding. After the winding is applied, a layer of foamable rubber, in a prefoamed condition, is applied around the winding layer and completely covers it. A foaming agent is applied to the foamable rubber. Narrow strips of seam material (high density black rubber) are then positioned over the foamable rubber at the locations where it is desired to create raised seams. This arrangement is then placed in a carcass mold where it is cured under temperature in conventional fashion.

During the molding process, the foamable layer expands into a cellular sponge rubber layer. At the same time, the seam strips are molded into raised seams. The end result, upon removal from the mold, is a carcass having a layer of sponge rubber covering the layer of winding and raised black seams partially covering the surface of the sponge rubber layer. The seam strips do not interfere with outgassing as the sponge layer is created.

As with typical leather game balls, the boundaries of the exterior skin panels are defined by the raised seams. Individual skin panels are bonded to the areas between seams. However, most of the inner surface area of each panel is bonded directly to the sponge rubber layer.

A ball constructed in accordance with the invention has a number of advantages. First, it can be used to construct a high-quality game ball having a soft feel. It is believed that this provides improvements in ball grip and handling characteristics.

Second, it is believed that the invention also enables the construction of a high-quality ball having a truer bounce. This is because a ball constructed in accordance with the invention will have the same bounce as a conventional ball but with less inflation pressure. Reduced inflation pressure makes it easier to maintain a truer spherical shape.

Last, it is believed that a ball constructed in accordance with the invention will wear better than a conventional ball. The sponge layer absorbs impacts and improves the durability of the skin panels used to make the exterior covering.

Although the invention is particularly well-suited for use in conjunction with basketballs, it is conceivable that it could be used to make other kinds of balls. Therefore, although the following description is mainly directed to basketball use, it is to be appreciated that the improvement claimed here could be adapted to other kinds of balls.

BRIEF DESCRIPTION OF THE DRAWINGS

In the drawings, like reference numerals and letters refer to like parts throughout the various views, and wherein.

BEST MODE FOR CARRYING OUT THE INVENTION

Figure 1:
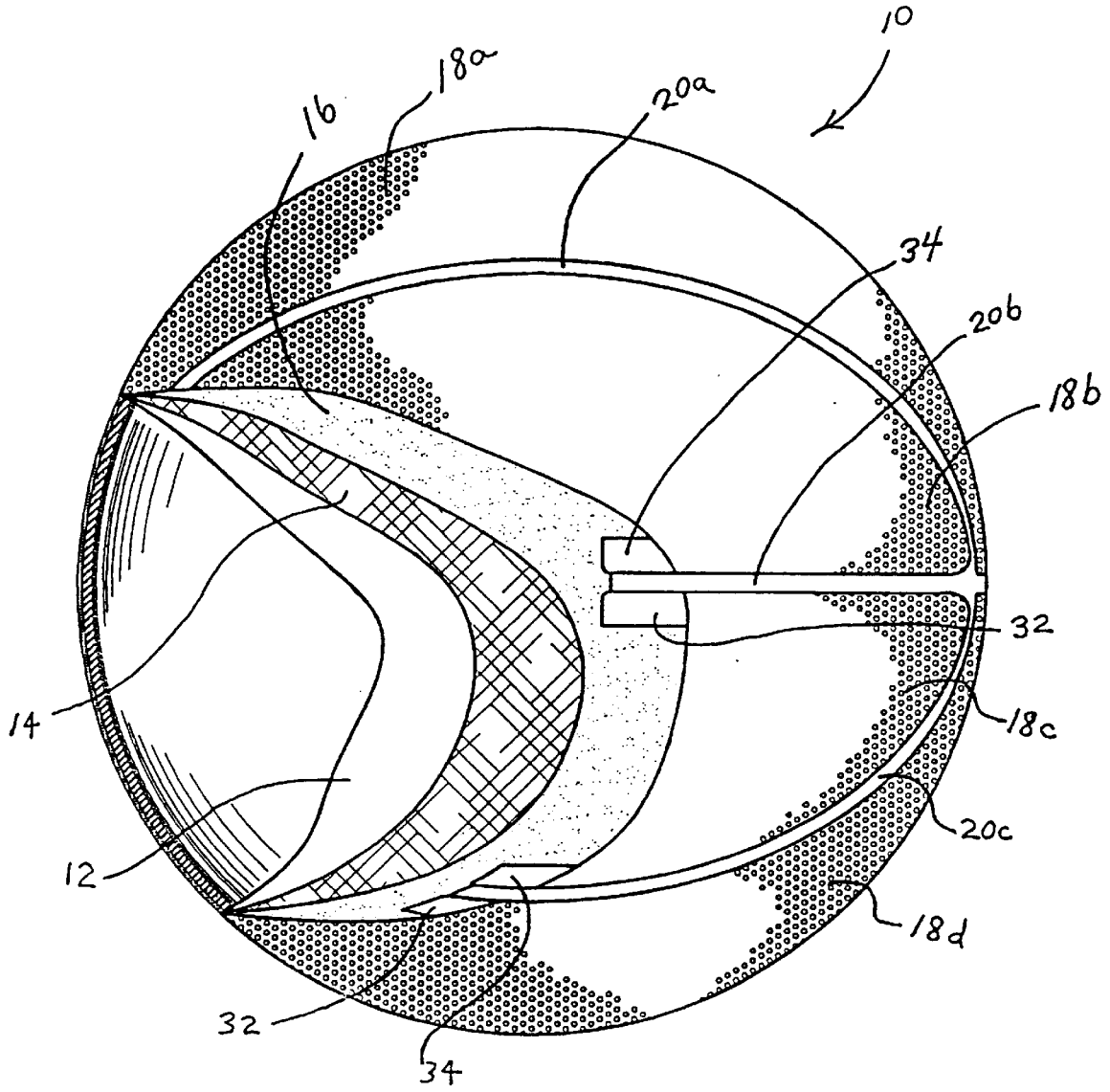
FIG. 1 is a pictorial view of a basketball constructed in accordance with the invention showing part of the ball cutaway in layers.
Figure 2:
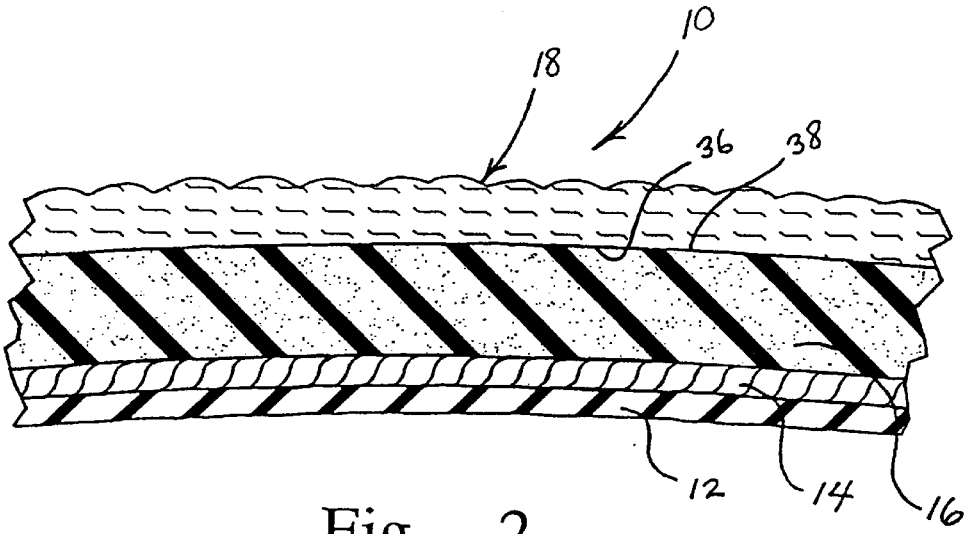
FIG. 2 is an enlarged, fragmentary sectional view illustrating the construction of the ball shown in FIG. 1 through its thickness.

Referring first to FIG. 1, shown generally at 10 is an improved basketball design constructed in accordance with a preferred embodiment of the invention. The basketball has an inner carcass structure, or inner carcass portion, consisting, in combination, of a rubber bladder 12 and a layer of winding 14 (see, for example, FIG. 2). The layer of winding 14 surrounds the bladder 12 in conventional fashion, as will be further described below.

In accordance with the invention, surrounding the winding layer 14 is a layer of cellular sponge 16. A plurality of skin panels 18*a*, 18*b*, 18*c*, 18*d* (numeral 18 is used in FIG. 2 to generally indicate any one of these panels), and a plurality of seams 20*a*, 20*b*, and 20*c* (numeral 20 is used in FIG. 3 to generally indicate any one seam) are bonded to the cellular layer 16. Under normal circumstances, the ball 10 will have a total of eight panels separated by seams, which is typical to basketballs.

Figure 3:
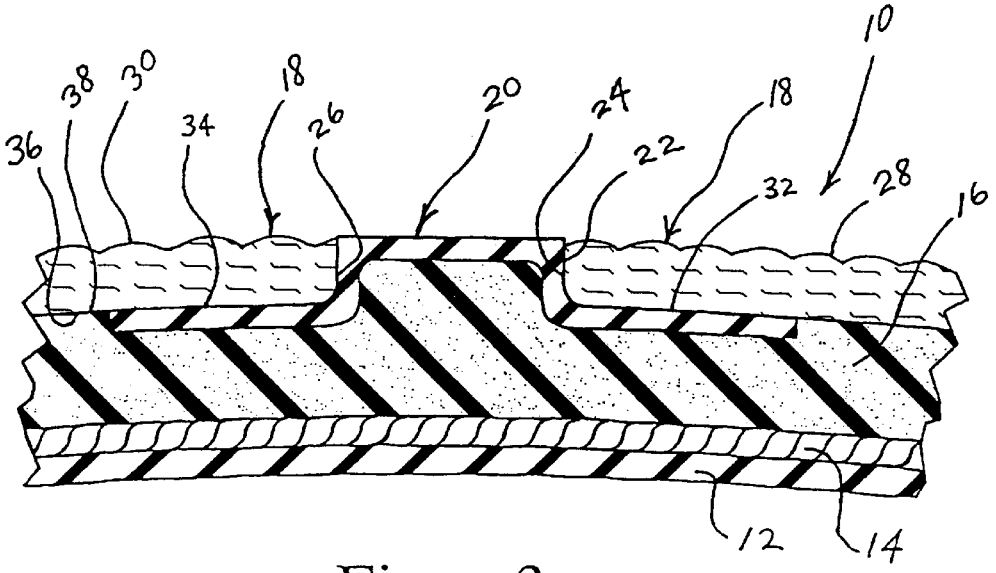
FIG. 3 is a view like FIG. 2, but is a cross-section through a seam area.

Referring now to FIG. 3, each seam 20 is made of a narrow strip of seam material—preferably a high density rubber. In preferred form, and similar to conventional basketballs, a raised central portion 22 of the seam material 20 fills the space between the outer edges 24, 26 of two adjacent skin panels 28, 30 (the skin panels 28, 30 are the same as any two panels 18*a*–18*d* shown in FIG. 1). Unlike conventional basketballs, however, narrow flanges 32, 34 of the seam material 20 extend outwardly, in opposite directions, a finite distance from the raised portion 22.

The flange portions 32, 34 underlie the overlapping panel edges 24, 26 and are also sandwiched between the panel edges and underlying sponge layer 16. In other areas, the skin panels 18*a*, 18*b* are bonded directly to the sponge layer 16, as shown at 36, 38 in FIGS. 2 and 3.

"Each flange portion 32, 34, terminates in an outwardly facing, vertical edge surface indicated at 41, 43, respectively, these vertical surfaces 41, 43, or edges, mate with the sponge layer 16. Essentially, the flange portions 32, 34 are embedded in the sponge layer 16 so that their upper surfaces or upper sides 47, 49, which define the lateral span or traverse from the raised central portion 22 to the vertical edges 41, 43, are substantially flush with the nearby upper side surface 45, 51 of the sponge layer 16. The smooth surface continuity between the lateral traverse of the flange portions 32, 34 and the upper surface of the sponge layer 45, 51 underlies the skin panels 28, 30. Together, these surfaces 45, 47, 49, 51 define an outer ball carcass surface near the central portion 22 of the seam material 20."

Figure 5:
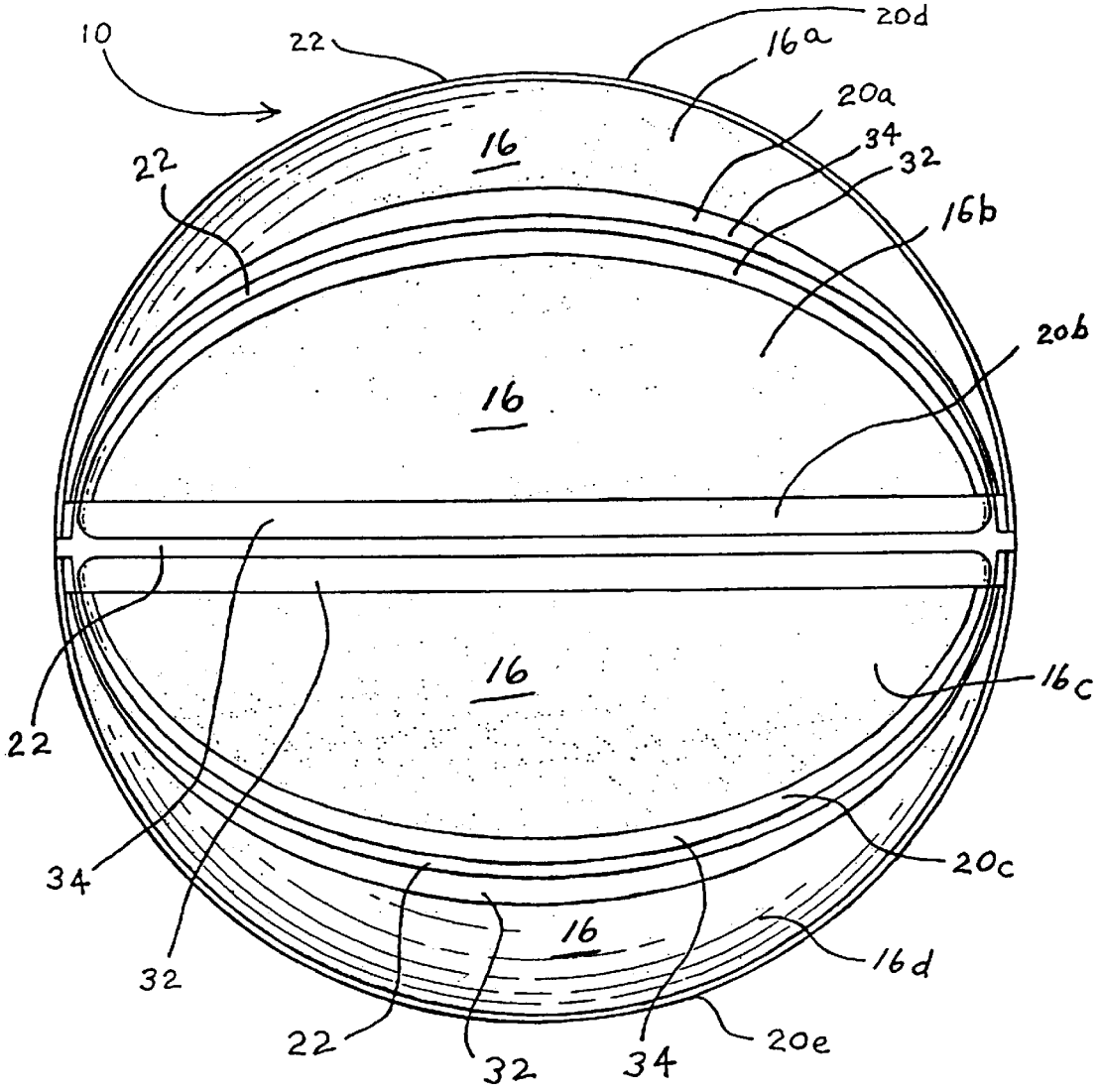
FIG. 5 is a view like FIG. 4, but shows the carcass with a sponge rubber layer and high density rubber seams after molding.

FIG. 5 illustrates the complete "carcass" of the ball 10 as described above. The term "carcass," as used here, means all ball components less the outer skin panels 18*a*–18*d*. As described above, the inner portion of the carcass consists of the rubber bladder 12 and winding layer 14. The outer portion consists of the sponge layer 16 and seams 20*a*–20*e*. It should be noted that two additional seams 20*d* and 20*e* can be seen in FIG. 5, which are not shown in FIG. 1, because the panels 18*a*–18*d* have been removed.

Figure 4:
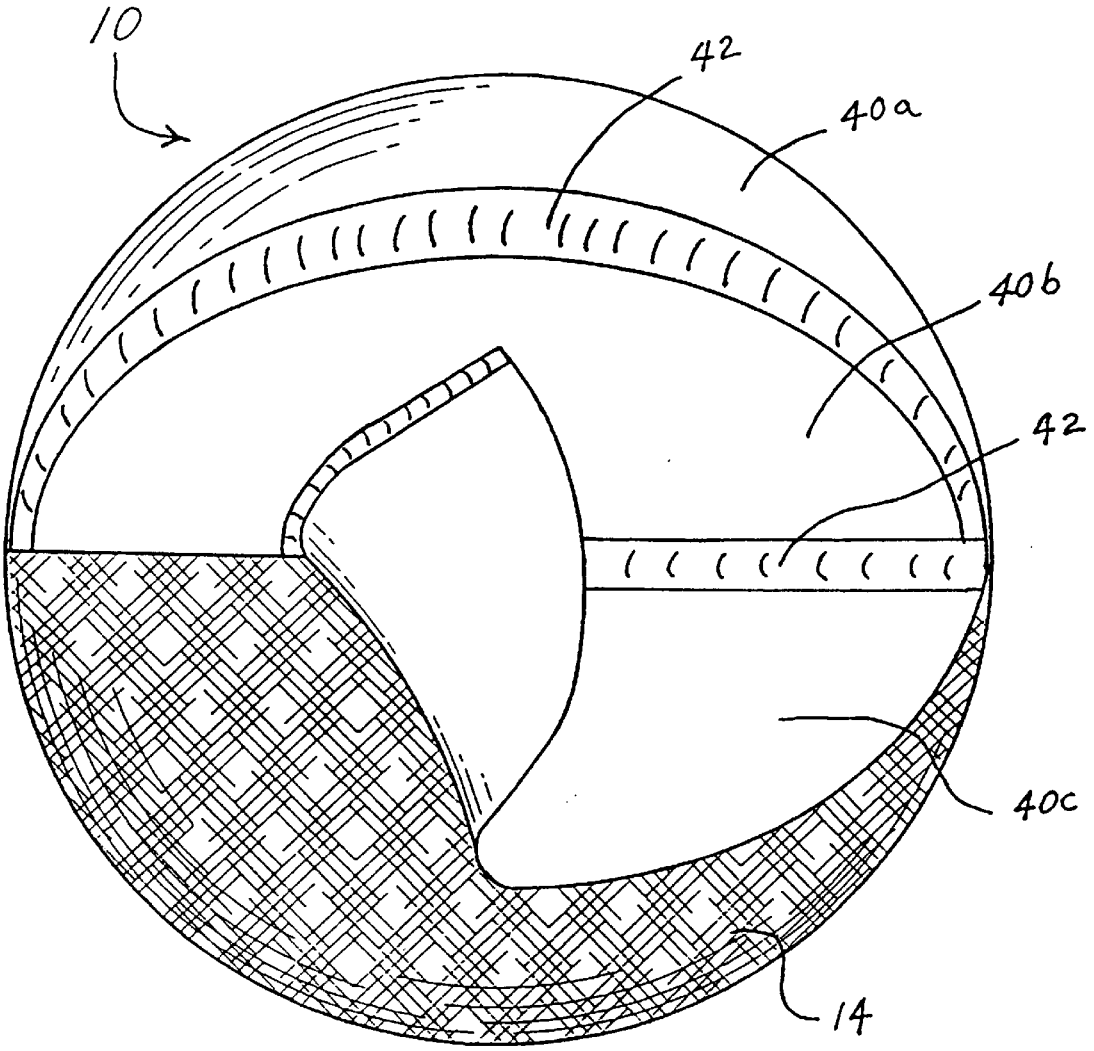
FIG. 4 is a view like FIG. 1, but shows the carcass of the ball prior to molding, with portions of a foamable rubber layer peeled back to reveal the underlying winding layer.

FIG. 4 illustrates how the carcass is constructed. The inner portion of the carcass (bladder and winding layer 12, 14) is made in conventional fashion which would be familiar to the person of skill in the art, but with the dimensions described below. After the winding layer 14 is attached to the bladder 12, a foamable rubber layer is attached to the winding layer in sections 40*a*, 40*b*, 40*c*. The size of these sections 40*a*–40*c* generally corresponds to the size of the skin panel sections 18*a*–18*d* shown in FIG. 1. Like the skin panel sections, there would be eight sections of prefoamed rubber. Only three 40*a*–40*c* can be seen in FIG. 4. These sections 40*a*–40*c* are made from a type of rubber designed to foam and create cellular sponge rubber upon application of heat. This type of rubber is well known and may be obtained from a variety of sources.

The winding layer 14 underlying the foamable sections 40*a*–40*c* is tacky prior to molding of the carcass, because the threads making up the winding are covered with glue. Consequently, the foamable sections 40*a*–40*c* will stick directly to the winding layer 14 and hold their position prior to placement in a mold.

After the foamable sections 40*a*–40*c* are attached to the winding layer 14, flat strips ("seam strips") of unformed seam material 42 (see FIG. 4) are placed over the discontinuities between individual foamable sections 40*a*–40*c*, in the general arrangement desired for ball seam locations. Although there may be many ways of attaching the unformed seams strip 38 to the foamable sections 36*a*–36*c*, any means which makes the seam strips tacky or sticky will suffice. For example, applying "white gas" to the seam strips 42 will make them sufficiently tacky. The unformed seam strips 42 are made from the same high density rubber which is used to make the outer rubber layer of conventional basketball carcasses.

After the foamable rubber sections 40*a*–40*c* and unformed seam strips 42 are in position, as shown in FIG. 4, the entire arrangement is placed into a carcass-forming mold. The mold is the same as that which is used to form conventional basketball carcasses.

In the mold, the carcass is cured under heat in the same way as conventional ball carcasses. The heat causes the foaming agent to expand the foamable sections 40*a*–40*c* into a single, uniform cellular sponge layer 16, the thickness of which is dependent on the space between the outer diameter of the winding layer 14 and the inner diameter of the mold and the amount of the out gate created by the foaming agent. The seam strips 42 are molded at the same time, thereby creating the raised seams familiar to conventional basketballs.

After curing, the carcass assumes the shape shown in FIG. 5. Most of the space or area between individual seams 20*a*–20*e* is taken up by exposed sections 16*a*–16*d* of the cellular sponge layer 16, since the flanges 32, 34 on each side of the raised seam portion 22 extend only a short distance across the sponge layer. During the curing process, any discontinuities between individual foamable sections 40*a*–40*c*, underlying the unformed seam strips 20, are melded together and become a uniform layer 16.

As described above, after the carcass is finished, individual skin panel sections 18*a*–18*d* are attached to the regions 16*a*–16*d* between the seams 20*a*–20*e*. The skin panels 18*a*–18*d* are attached in conventional fashion by a bonding agent. As described above, this is followed by a final finishing process in a conventional manner.

One of the differences between the above design and conventional basketballs is that seam strips 20*a*–20*e* are used to make individual seams, as opposed to a continued rubber layer that completely surrounds the winding layer. Using seam strips 20*a*–20*e* is important because it does not affect the outgassing of the cellular layer 16 as it is being formed.

As indicated above, the ball carcass is molded in the same way as conventional balls. However, the dimensions of certain components must be altered somewhat so that the finished carcass will have the same weight and diameter as a "regulation" ball.

In a regulation ball, the rubber bladder 12 usually has an outer diameter of 232–234 mm. when inflated. In accordance with the invention, this diameter should be reduced to 229–230 mm. The thickness of the winding layer should remain about the same. During the curing process, the foamable layer expands to a thickness of approximately 1.20 mm. Nevertheless, the thickness after expansion is limited by the inner diameter of the mold and the amount of the out gate created by the foaming agent. The panel sections 18*a*–18*d* remain unchanged from conventional basketballs.

Set forth below are the weight specifications for the various components described above. The valve housing and core and balance patch were not described above as they are the same as conventional balls.

WEIGHT TABLE

| | |
|---|---|
| Bladder | 100–110 grams |
| Valve Housing and Core | 4 grams |
| Balance Patch | 5 grams |
| Winding Thread | 50 grams |
| Winding Glue | 10 grams |
| Foamable Rubber | 167–172 grams |
| Seam Strips | 50 grams |
| Panel Glue | 24 grams |
| Panels (eight) | 180–185 grams |
| TOTAL | 590–610 grams |

It is believed that the embodiment described above is the best mode for carrying out the invention. The scope of patent coverage should not be deemed limited by the above description. Instead, the spirit and scope of the invention is to be limited only by the patent claim or claims which follow, the interpretation of which is to be made in accordance with the established doctrines of patent claim interpretation.

What is claimed is:

1. A padded inflatable ball, comprising:

an inner carcass portion defining the shape of the ball, a cellular sponge material surrounding at least a majority of the inner carcass portion, a plurality of raised seams connected to the inner carcass portion and defined by strips of a seam material, wherein the inner carcass portion, the cellular sponge material and raised seams together define a ball carcass, and a plurality of skin panels attached to the ball carcass between the seams, and wherein each strip of seam material includes a raised portion positioned between spaced, outer edges of skin panels on opposite sides of the raised portion, and flange portions which extend away from opposite sides of the raised portion, the lateral traverse of each flange portion terminates in an outwardly facing edge surface that mates with the cellular sponge material, and an upper side of each flange portion is substantially flush with an upper side of the cellular sponge material and together the flange portion and cellular sponge material define an outer ball carcass surface region which underlies the skin panels.

2. The ball of claim 1, wherein the inner carcass portion comprises an inflatable bladder and a layer of winding surrounding the inflatable bladder.

3. The ball of claim 2, wherein the cellular sponge material also underlies the strips of seam material, and the seam material strips are bonded directly to the cellular sponge material.

* * * * *